US006615007B2

(12) United States Patent
Nakamura et al.

(10) Patent No.: US 6,615,007 B2
(45) Date of Patent: Sep. 2, 2003

(54) TONER CONTAINER HOLDING DEVICE AND COPY MACHINE HAVING THE TONER CONTAINER HOLDING DEVICE

(75) Inventors: Masashi Nakamura, Tokyo (JP); Mitsuhiro Koumoto, Tokyo (JP)

(73) Assignee: Panasonic Communications Co., Ltd., Fukuoka (JP)

( * ) Notice: Subject to any disclaimer, the term of this patent is extended or adjusted under 35 U.S.C. 154(b) by 0 days.

(21) Appl. No.: 10/237,747

(22) Filed: Sep. 10, 2002

(65) Prior Publication Data

US 2003/0049044 A1 Mar. 13, 2003

(30) Foreign Application Priority Data

Sep. 12, 2001 (JP) ..... 2001-276764

(51) Int. Cl.[7] ..... G03G 15/08
(52) U.S. Cl. ..... 399/103
(58) Field of Search ..... 399/103, 105, 399/106, 102, 258, 262, 91; 222/DIG. 1, 325, 326, 327, 542; D18/43; 141/368

(56) References Cited

U.S. PATENT DOCUMENTS 5,557,382 A * 9/1996 Tatsumi et al. ..... 399/262
6,246,854 B1 6/2001 Kurosawa et al. ..... 399/263

FOREIGN PATENT DOCUMENTS

JP 07295355 A * 11/1995 ..... G03G/15/08
JP 2000112214 A * 4/2000 ..... G03G/15/08

* cited by examiner

*Primary Examiner*—Susan S. Y. Lee
*Assistant Examiner*—Ryan Gleitz
(74) *Attorney, Agent, or Firm*—Greenblum & Bernstein, P.L.C.

(57) ABSTRACT

A toner container holding device that engages with a toner container having a first opening to supply toner to a developing device is provided. The toner container holding device includes a container holder that detachably holds the toner container and has a second opening at a position coinciding with the first opening, and a hopper frame that stores the toner received from the toner container. A first seal member if provided between the toner container and the container holder, when the toner container is engaged with the container holder. A second seal member is provided between the container holder and the hopper frame. The container holder has an opening portion spaced from the first and second seal members.

16 Claims, 5 Drawing Sheets

TONER CONTAINER HOLDING DEVICE AND COPY MACHINE HAVING THE TONER CONTAINER HOLDING DEVICE

BACKGROUND OF THE INVENTION

1. Field of the Invention

This invention is related to a toner container holding device that detachably carries a toner bottle (container), and a copy machine having the toner container holding device.

2. Description of Related Art

Conventionally, as shown in FIG. 6, one type of toner bottle holding device to receive a toner bottle 601 includes a bottle holder 602 and a hopper frame 603. The toner bottle 601 is a replaceable component carrying toner as consumable supplies. The toner bottle 601 has a spiral rib 601A on the inner wall, and an opening 601B at one end in a leading direction of the spiral ribs 601A. When the toner bottle 601 rotates, the rib 601A carries the interior toner toward the end of the toner bottle 601, and the toner is discharged to the exterior from the opening 601B.

The bottle holder 602 detachably engages with the toner bottle 601. The bottle holder 602 has an opening 602A at a position corresponding to the opening 601B of the toner bottle 601 when the toner bottle 601 engages with the bottle holder. In addition, the bottle holder 602 has a gear on the outer peripheral surface. The gear engages with a driving gear employed on the body of the copying machine and rotates the bottle holder 602. The rotation of the bottle holder 602 rotates the toner bottle 601, which engages with the bottle holder 602. Accordingly, the toner in the toner bottle 601 advances toward the opening 601B, passes through the opening 602A and is discharged to the exterior.

The hopper frame 603 is attached to the bottle holder 602. A supply roller 603A is provided in the hopper frame 603, and supplies toner to a developing device located under the toner bottle holding device. The hopper frame 603 temporarily stores toner discharged from the toner bottle 601 and then supplies the toner to the developing device.

The toner bottle holding device as constructed above, works as follows. First, when the toner density sensor provided in the developing device detects low toner density in the developing device, the supply roller 603A in the hopper frame 603 rotates to supply the toner into the developing device in the hopper frame 603. Next, when a toner volume sensor provided in the hopper frame 603 detects a low toner volume (quantity) in the hopper frame 603, the toner bottle 601 rotates to provide a required toner volume (quantity) in the hopper frame 603.

However, the above-described conventional toner container has the following problems.

When the toner bottle 601 is forcibly being engaged with the bottle holder 602, the air pressure scatters the toner toward the operator. This problem occurs due to the insufficient packing between the toner bottle 601 and the bottle holder 602, and between the bottle holder 602 and the hopper frame 603.

More in detail, as shown in FIG. 7, the toner discharged from the opening 601B of the toner bottle 601 sometimes flows into the bottle holder 602 as well as the hopper frame 603. Under the circumstance in which the toner flowing into the bottle holder 603 is accumulated, when the toner bottle 601 is forcibly being engaged with the bottle holder 602, as shown in FIG. 8, the air pressure generated at that time scatters the toner accumulated in the bottle holder 602. Thus, there is a problem that the toner flies in the air and dirties (contaminates) the operator.

SUMMARY OF THE INVENTION

The present invention is provided in view of the above-described problems, and the objective of the present invention is to provide a toner bottle (container) holding device and a copier/duplicator that can prevent both the operator and the interior of the device from being contaminated by toner, even when the toner bottle is forcibly being engaged with the bottle holder.

The present invention includes seal members to close a path that is formed between the toner bottle and the bottle holder and between the bottle holder and the hopper frame and through which the toner leaks to the exterior, and an opening through which the air pressure generated when the toner bottle is being engaged with a predetermined position of the bottle holder, is released to the exterior.

According to the present invention, the seal members prevent the toner from scattering toward the operator. In addition, the seal members prevent the air pressure generated when the toner bottle is being engaged with a predetermined position of the bottle holder from concentrating in the hopper frame, and thus prevent the toner in the hopper frame from scattering in the toner container holding device (copying machine).

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein.

DETAILED DESCRIPTION OF PREFERRED EMBODIMENTS

The embodiments of the toner bottle (container) holding device and the copy machine of the present invention are explained in the following, with reference to the above-described drawings.

Figure 1:
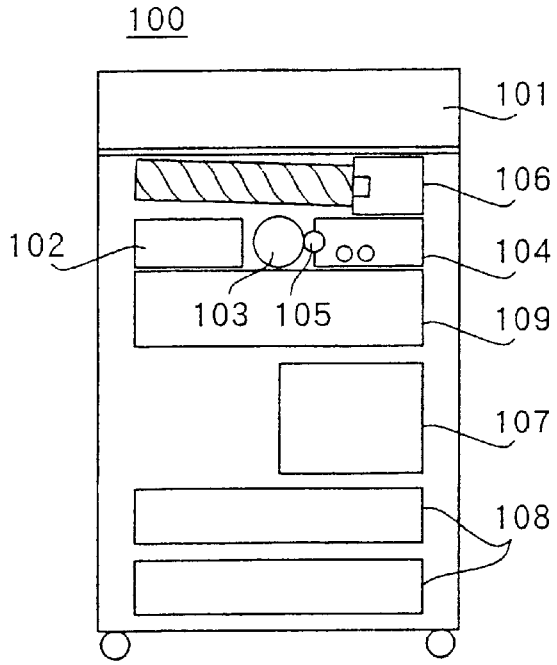
FIG. 1 is a schematic cross-sectional view illustrating a construction of a copy machine carrying a toner bottle (container) holding device according to the first embodiment of the present invention.

FIG. 1 is a schematic cross-sectional view illustrating a construction of a copy machine carrying a toner bottle (container) holding device according to a first embodiment of the present invention.

As shown in FIG. 1, the copy machine 100 is provided with a scanner (reading device) 101, which scans (reads) an original, at a top of the copying machine. A laser scanning unit (LSU), including a laser driving device and a polygon mirror, etc., forms an electrostatic image on a photo-sensitive drum 103 in accordance with image data of an original read by the scanner 101.

A developing device 104 is positioned adjacent to the photo-sensitive drum 103. The photo-sensitive drum 103 is positioned so as to contact a developing roller 105 provided in the developing device 104. The developing device 104 is positioned under a toner bottle holding device 106 and receives toner from the toner bottle holding device 106.

The developing roller 105 adheres toner to the electrostatic image formed by the LSU on the photo-sensitive drum 103. The toner on the photo-sensitive drum 103 is transferred to a paper sheet conveyed from a paper cassette 107 or a large volume paper cassette 108, which is added to the copying machine 100.

When images are formed on both sides of the conveyed sheet, the sheet having an image on one side is stored in an auto document unit (ADU) 109. Then, after the auto document unit turns the sheet up-side-down, the sheet is conveyed again to the image transferring area and another image is formed on the other side of the sheet. After the image is transferred on the sheet, the fixing (fuser) section 102 fixes the image on the sheet and the sheet is discharged to the exterior of the copying machine 100.

Figure 2:
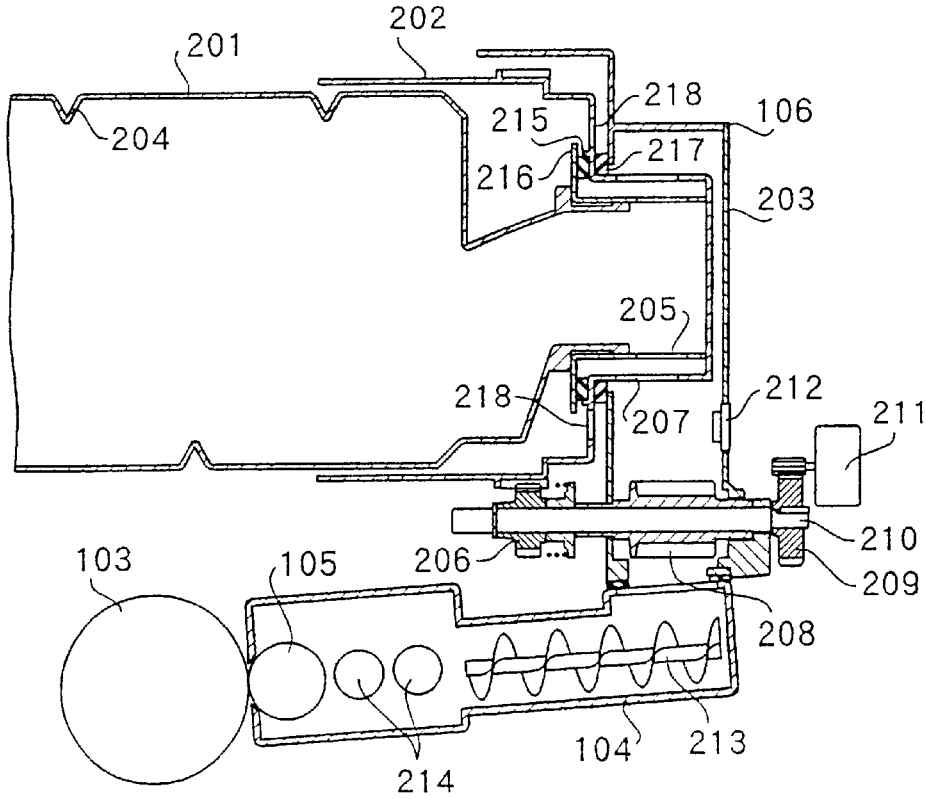
FIG. 2 is an enlarged cross-sectional view illustrating a portion of the toner bottle holding device according to the first embodiment of the present invention.

FIG. 2 is an enlarged cross-sectional view illustrating a portion of the toner bottle holding device 106. In FIG. 2, the toner bottle holding device 106, the developing device 104 and the photo-sensitive drum 103 are selectively shown.

As shown in this figure, the toner bottle holding device 106, which receives a toner bottle (container) 201, includes a bottle (container) holder 202 and a hopper frame 203. The toner bottle 201 is a replaceable component storing toner as consumable supplies (expendable). The toner bottle 201 has a spiral rib 204 on the inner wall, and an opening 205 at an end in a leading direction of the spiral to dispose the toner to the exterior. When the toner bottle 201 rotates, the rib 204 conveys the interior toner toward the end of the toner bottle 201 so that the toner is discharged to the exterior through the opening 205.

The toner bottle 201 detachably engages with the bottle holder 202. The bottle holder 202 includes a gear on the outer peripheral surface. The gear engages with a driving gear 206 supported by a shaft of a supply roller in the hopper frame 203, which will be described later, so as to rotate the bottle holder 202. The rotation of the bottle holder 202 rotates the toner bottle 201, which engages with the bottle holder 202. Accordingly, the toner in the toner bottle 201 advances toward the opening 205.

Further, the bottle holder 202 has an opening 207 at the position coinciding with the opening 205 of the toner bottle 201 when the bottle holder 202 engages with the toner bottle 201. The toner discharged from the toner bottle 201 is supplied to the hopper frame 203 through the opening 207.

The bottle holder 202 is attached to the hopper frame 203. A supply roller 208 is provided in the hopper frame 203 and supplies toner to the developing device 104 provided under the hopper frame 203. The hopper frame 203 temporarily stores the toner discharged from the toner bottle 201 and then supplies the toner to the developing device 104. The supply roller 208 is supported by a shaft 210 having a driving gear 209 at an end. A motor 211 gives a driving force to the driving gear 209 to rotate the supply roller 208.

A driving gear 206 is further provided at another end of the shaft 210, opposite to the end having the driving gear 209. The driving gear 206 engages with the gear formed on the outer peripheral surface of the bottle holder 202. The driving gear 206 is attached to the shaft 210 via a one-way clutch. Accordingly, the driving gear 206 rotates the bottle holder 202 when a rotation force is applied in a direction opposite to the rotation of the supply roller 208.

A toner volume (quantity) sensor 212, which detects the volume (quantity) of the toner inside of the hoper frame 203, is attached in a side wall of the hopper frame 203. When the toner volume sensor 212 detects that the toner in the hopper frame 203 is decreased less than a predetermined amount, the toner volume sensor 212 commands the motor 211 to rotate the bottle holder 202. Thus, the toner is supplied from the toner bottle 201 so that the toner volume in the hopper frame 203 is kept in constant.

The developing device 104 has an agitation coil 213 and an agitation roller 214, which agitate the toner supplied from the hopper frame 203 and conveys the toner toward the developing roller 105. The developing roller 105 holds the conveyed toner on its face, and adhere the toner to the electrostatic latent image formed on the photo-sensitive drum 103.

The toner bottle holding device 106 according to the first embodiment of the present invention includes seal members and an opening. The seal members are respectively formed between the toner bottle 201 and the bottle holder 202 and between the bottle holder 202 and the hopper frame 203, so as to close a path through which the toner leaks to the exterior. The opening is provided to discharge air to the exterior when the toner bottle 201 is forcibly being engaged with a predetermined position of the bottle holder 202. The seal members and the opening are explained in detail in the following.

A first seal member 215 is provided (attached) between the toner bottle 201 and the bottle holder 202 so as to close the path through which the toner discharged from the opening 205 of the toner bottle 201 leaks to the exterior. The seal member 215 is attached at the position adjacent to an end of the toner bottle 201 and between the side wall of the bottle holder 202 and a collar portion 216 facing the side wall of the bottle holder 202.

The first seal member 215 can be adhered (attached) to a predetermined position on the collar portion 216 of the toner bottle 201, or can adhere to a predetermined position on a side face of the bottle holder 202. In this embodiment, the first seal member 215 is adhered to a predetermined position on the side face of the bottle holder 202.

Figure 3:
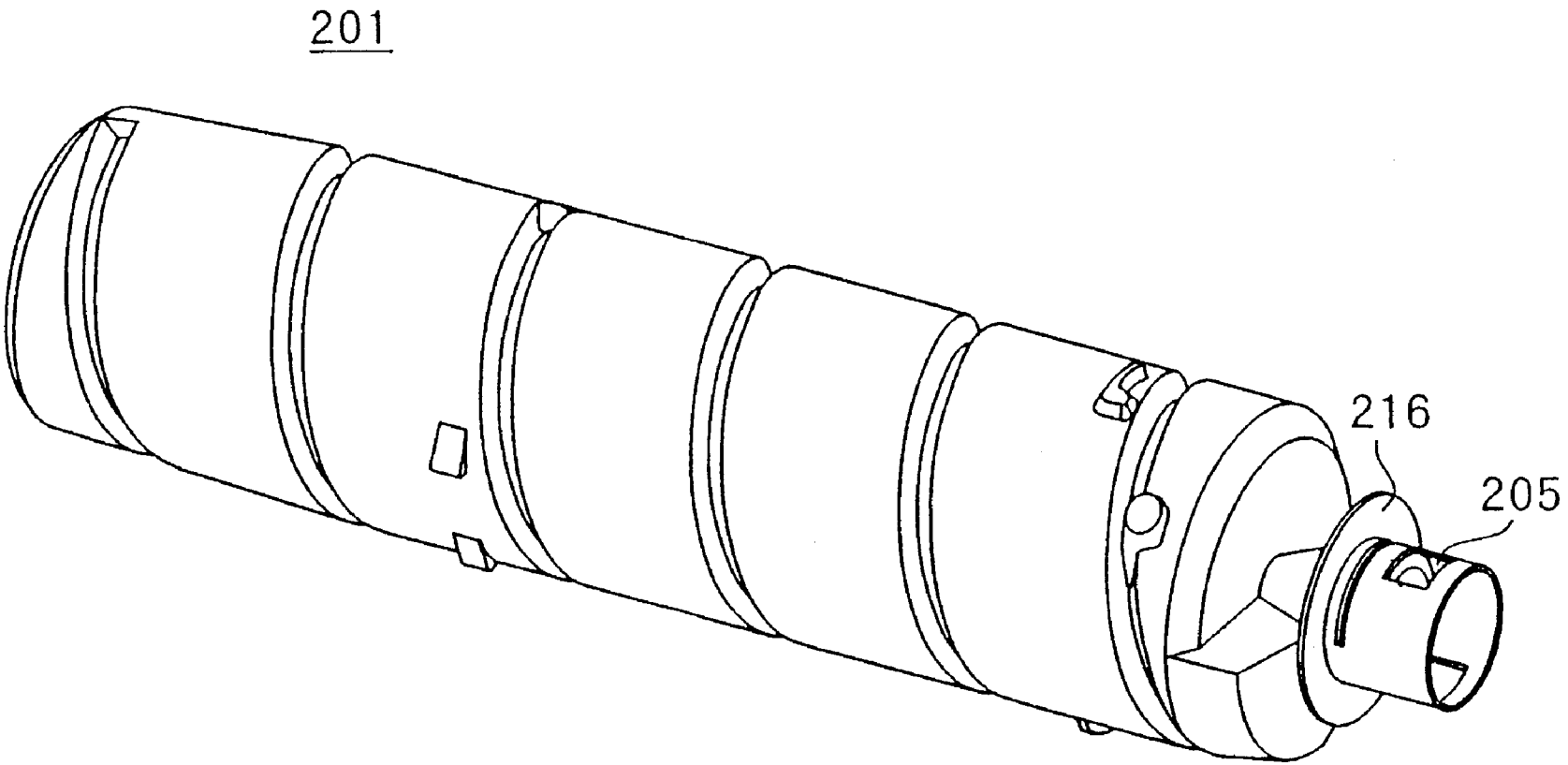
FIG. 3 is an enlarged perspective view illustrating a toner bottle (container) held in the toner bottle holding device according to the first embodiment of the present invention.

FIG. 3 is an enlarged perspective view illustrating the toner bottle 201 contained in the toner bottle holding device 106 according to the embodiment of the present invention. As described above, the toner bottle 201 is provided with the collar portion 216 at a position adjacent to one end. The collar portion 216 projects vertically and outwardly (radially) from the end of the toner bottle 201.

The collar portion 216 can be unitarily formed with the toner bottle 201 in one piece, but is not restricted thereto. For example, the collar portion 216 can be unitarily formed with a cap having the opening 205 in one piece, and can engage with the end of the toner bottle 201.

Because the collar portion 216 to which the first seal member 215 is pressed, is provided as described above, the first seal member 215 is not directly held between the side face of the toner bottle 201 and the bottle holder 202, rather is held between the collar portion 216 and the bottle holder 202. Accordingly, the air tightness can be improved without increasing the positioning precision between the side face of the toner bottle 201 and the bottle holder 202.

Further, since the toner adheres only to the end (front) side of the toner bottle from the position where the collar portion 216 is provided, the rear side from the collar portion 216 of the toner bottle 201 is prevented from being contaminated. In addition, when the toner bottle 201 is being replaced, if the operator pays attention to the conspicuous collar portion 216 and tries not to touch the end (front) side from the collar portion 216, the operator's hands are securely prevented from being contaminated.

In reference to FIG. 2 again, a second seal member 217 is provided between the bottle holder 202 and the hopper frame 203. The second seal member 217 closes a path through which the toner discharged from the opening 207 of the bottle holder 202 leaks to the exterior. The second seal member 217 is held between the side face of the bottle holder 202 and the side face of the hopper frame 203.

The second seal member 217 can also be adhered (attached) to a predetermined position on the side face of the bottle holder 202, or to a predetermined position on the side face of the hopper frame 203. In the present embodiment, the second seal member 217 is adhered to the predetermined position on the side face of the bottle holder 202.

The first seal member 215 and the second seal member 217 have a circular (annular) shape so as to fit to the shape of the end portion of the toner bottle. Further, the first seal member 215 and the second seal member 217 face each other so as to hold the bottle holder 202 therebetween. In the present embodiment, since both seal members adhere to the bottle holder 202, the first and second seal members adhere to the opposing faces of the side wall of the bottle holder so as to hold the side wall of the bottle holder 202 therebetween.

Further, as shown in FIG. 2, the first seal material 215 and the second seal material 217 are attached to the position adjacent to (spaced from) the opening 205 and the opening 207 through which the toner is discharged from the toner bottle 201.

The toner bottle holding device 106 of the present embodiment, the first seal member 215 and the second seal member 217 close the path through which the toner leaks. Accordingly, even if the toner is scattered, the scattered toner is collected inside the position of the first seal position 215 and the second seal position 217. Thus, since the first seal member 215 and the second seal member 217 are provided adjacent to the opening 205 and the opening 207, the area in which the toner is scattered can be reduced to a minimum (an optimum) space. Consequently, when the toner bottle 201 is being replaced, the area of the toner bottle 201 which makes the hands dirty by contact can be reduced, and thus, the operator is securely prevented from being contaminated by toner.

Thus, a packing between the toner bottle 201 and the bottle holder 202 and another packing between the bottle holder 202 and the hopper frame 203 are provided. Accordingly, the path through which the toner flows to the exterior is blocked and the toner is prevented from accumulating in the bottle holder 202.

These packing, i.e., the first and second seal members prevent the toner-outflow; however, another problem might occur that the toner contaminates interior of the copying machine instead of the operator. In other words, since the packing prevents toner-outflow, the toner is not directed toward the operator. However, since the air pressure generated when the toner bottle 201 is forcibly being engaged with the toner holder 202 does not disappear, the toner is strongly directed toward the interior of the hopper frame 203. Consequently, the air pressure is supplied to the toner in the hopper frame 203, and the toner leaks out through a variety of gaps of the hopper frame 203, for example, an opening in which a shaft of the supply roller is inserted, and scatters to the exterior. Thus, the toner contaminates the interior of the device.

To avoid this problem, an opening portion 218 is formed in the side face (wall) of the bottle holder 202 and outside of the position where the first seal member 215 and the second seal member 217 are adhered. The opening portion 218 forms a path through which the air pressure generated in the bottle holder 202 when the toner bottle 201 is being engaged with the bottle holder 202 is released to the exterior by using an existing space between the bottle holder 202 and the hopper frame 203.

Thus, because the air pressure is released by using the existing path (space) between the bottle holder 202 and the hopper frame 203, the structure to release the air pressure to the exterior can be realized simply and easily.

In the toner bottle holding device 106 of the present embodiment, the first seal member 215 and the second seal member 217 are positioned facing each other so as to hold the bottle holder 202 therebetween. The opening portion 218 formed in the bottle holder 202 must be positioned outside the first seal member 215 and the second seal member 217. Thus, the more the attachment positions of the first seal member 215 and the second seal member 217 move inside, the more the flexibility of the position and the size of the opening portion 218 increase. Since the toner bottle holding device 106 of the present embodiment has the first seal member 215 and the second seal member 217 located to face each other and to hold the bottle holder 202 therebetween, the position and the size of the opening portion 218 can be more flexible. Thus, an opening portion can be formed to effectively release the air pressure generated in the bottle holder 202.

Figure 4:
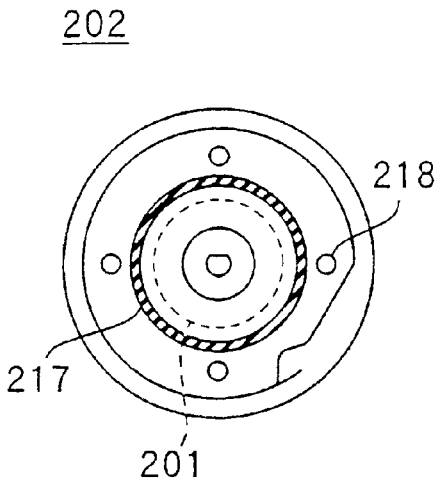
FIG. 4 is an enlarged cross-sectional side view illustrating a side face of the bottle holder in the toner bottle (container) holing device according to the first embodiment of the present invention.

FIG. 4 is an enlarged cross-sectional view illustrating a side face of the bottle holder 202 to which the second seal member 217 adheres. As described above, the second seal member 217 has a circular shape along the shape of the end face of the toner bottle 201. The first seal member 215 is provided on the rear side of the bottle holder 202 and has the shape similar to that of the second seal member 217.

A plurality of opening portions 218 are formed outside of the second seal member 217. In FIG. 4, four opening portions 218 are formed; however, it is not limited thereto. Any number of the opening portions 218 can be formed, as long as the air pressure generated in the bottle holder 202 can be released to the exterior when the toner bottle 201 is being engaged with the bottle holder 202.

Figure 5:
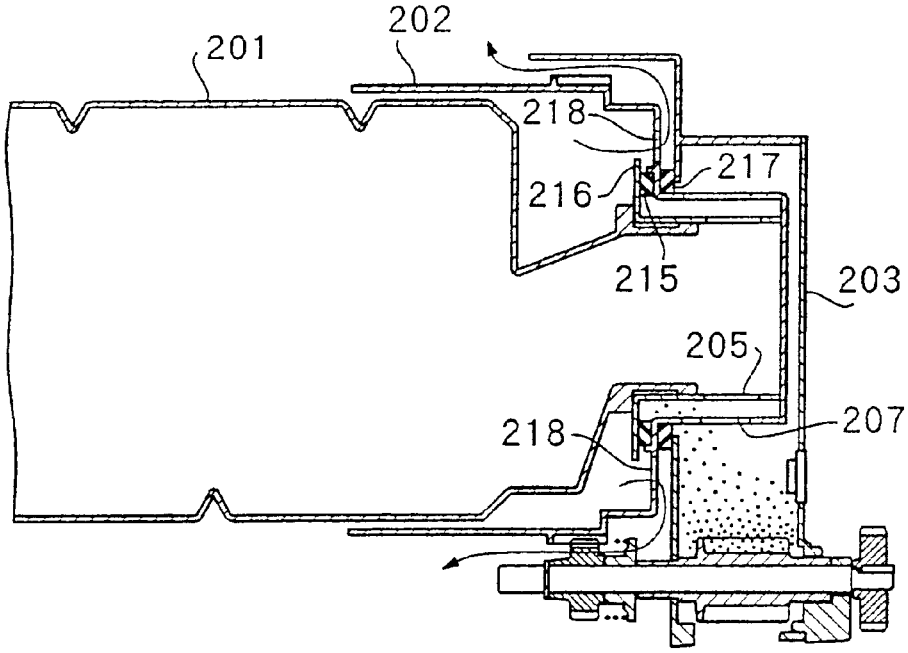
FIG. 5 is a cross-sectional view of the toner bottle holding device to explain a state when the toner bottle engages with the bottle holder, according to the first embodiment of the present invention.
Figure 6:
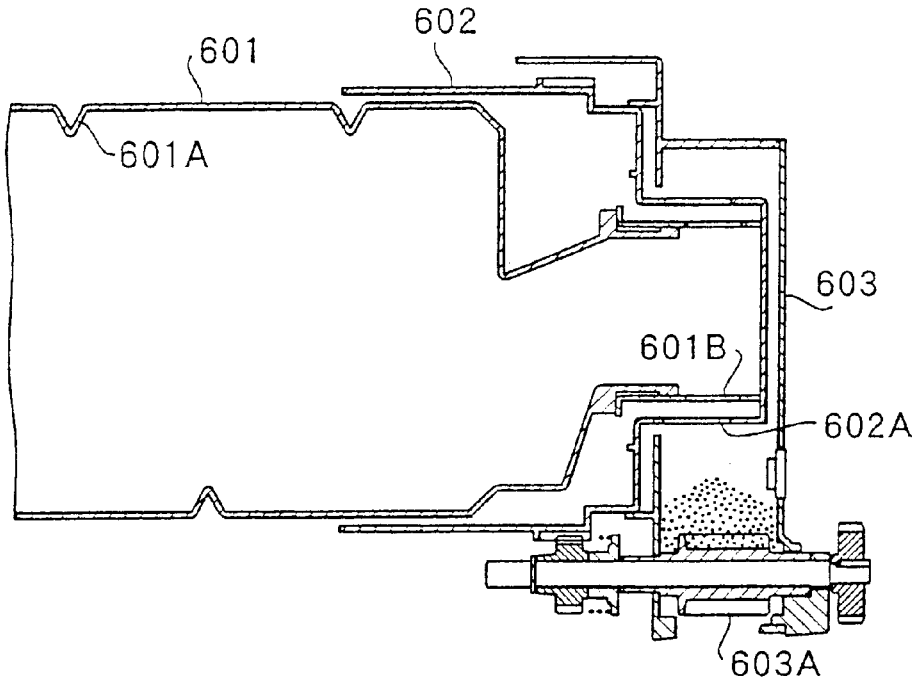
FIG. 6 PRIOR ART
FIG. 6 is an enlarged cross-sectional view illustrating a construction of a conventional toner bottle holding device.
Figure 7:
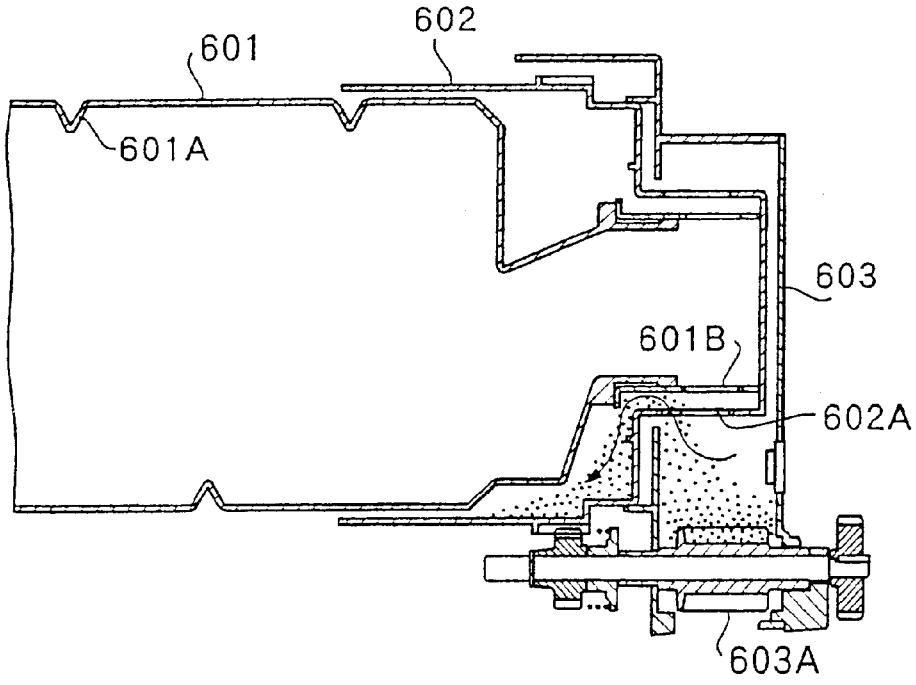
FIG. 7 PRIOR ART
FIG. 7 is an enlarged cross-sectional view illustrating the construction of the conventional toner bottle holding device.
Figure 8:
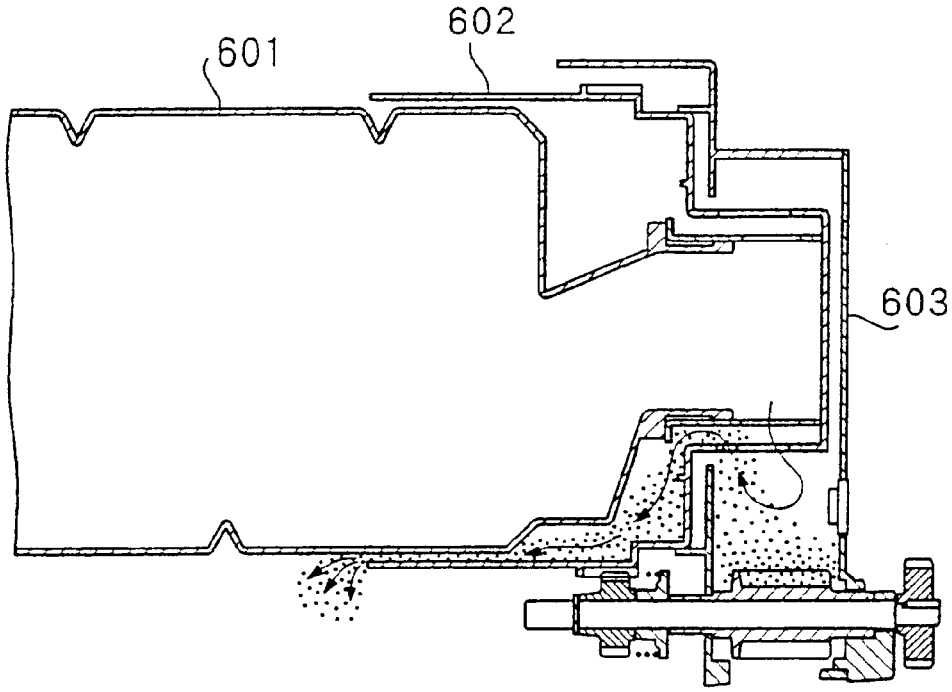
FIG. 8 PRIOR ART
FIG. 8 is an enlarged cross-sectional view illustrating the construction of the conventional toner bottle holding device.

A state of the toner bottle holding device 106 having the above-described construction, with which the toner bottle 201 engages, is explained in the following. FIG. 5 is a view to explain the state of the toner bottle holding device 106 of the present embodiment, in which the toner bottle 201 engages with the toner bottle holder 202.

When an image forming operation is actually performed using the toner bottle holding device 106 of the present embodiment after the toner bottle 201 is engaged, the space between the toner bottle 201 and the bottle holder 202 and the space between the bottle holder 202 and the hopper frame 203 are respectively closed by the first seal member 215 and the second seal member 217. Accordingly, as shown in FIG. 5, the toner discharged from the opening 205 of the toner bottle 201 and the toner discharged from the opening 207 of the bottle holder 202 does not leak to the exterior and does not accumulate in the bottle holder 202.

When the toner bottle 201 must be replaced, and thus, the toner bottle 201 is being engaged with the bottle holder 202, the bottle holder 202 has the opening portion 218 in the predetermined position, and accordingly, as shown in FIG. 5, the air pressure generated in the bottle holder 202 when the toner bottle 201 is being engaged with the bottle holder 202 is released to the exterior through the space between the bottle holder 202 and the hopper frame 203.

As described above, according to the toner bottle holding device 106 of the present embodiment, when the toner bottle 201 is forcibly being engaged with the bottle holder 202, the air pressure generated at that time is released to the exterior through the path which is formed between the bottle holder 202 and the hopper frame 203 and outside of the second seal member 217. Thus, the air pressure is prevented from being concentrated in the hopper frame 203, and the toner in the hopper frame 202 can be prevented from scattering in the device. Accordingly, even when the toner bottle 201 is forcibly being engaged with the bottle holder 202, the first seal member 215 and the second seal member 217 prevent the toner from scattering toward the operator, and from scattering in the toner container holding device (copying machine). Thus, both the operator and the interior of the device can be securely prevented from being contaminated by the toner.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

This application is based on the Japanese Patent Application No. 2001-276764 filed on Sep. 12, 2001, entire content of which is expressly incorporated by reference herein.

What is claimed is:

1. A toner container holding device that engages with a toner container storing toner and supplying the toner from a first opening provided at an end of the toner container, the toner container holding device comprising:

a container holder that detachably holds the toner container and has a second opening at a position coinciding with the first opening;

a hopper frame that stores the toner received from the toner container;

a first seal member provided between the toner container and the container holder when the toner container is engaged with the container holder, the first seal member sealing a space between the toner container and the container holder so as not to scatter the toner from the first opening, via the space between the toner container and the container holder to the exterior;

a second seal member provided between the container holder and the hopper frame, the second seal member sealing the space between the container holder and the hopper frame so as not to scatter the toner from the first opening, via the space between the container holder and the hopper frame to the exterior when the toner container is engaged with the container holder; and the container holder having an opening portion outside of the place where the first and second seal members are provided, the opening portion providing a path so that an air pressure generated in the container holder when the toner container is being engaged with the container holder, is released via the space between the container holder and the hopper frame.

2. The toner container holding device according to claim 1, wherein the first seal member and the second seal member face each other and hold the container holder therebetween.

3. The toner container holding device according to claim 1, wherein the first seal member and the second seal member are positioned at a periphery of the first opening and the second opening when the toner container engages with the container holder.

4. The toner container holding device according to claim 1, wherein the toner container has a collar portion, and the first seal member is held between the collar portion and the container holder when the toner container engages with the container holder.

5. The toner container holding-device according to claim 1, wherein said first seal member and said second seal member are secured to said container holder, at opposing surface a wall of said container holder.

6. The toner container holding device according to claim 1, wherein said opening portion comprises a plurality of circumferentially spaced opening portions.

7. The toner container holding device according to claim 1, said first seal member being configured to abut against a collar of the toner container that extends in a direction transverse to a longitudinal direction of said toner container.

8. The toner container holding device according to claim 1, said opening portion being provided in a wall surface of said container holder against which at least one of said first seal member and said second seal member one of abut and are secured to.

9. A copy machine comprising:

a developing device;

a toner container that stores toner in an interior thereof and supplies the toner from a first opening provided at an end of the toner container;

a container holder that detachably holds the toner container and has a second opening at a position coinciding with the first opening;

a hopper frame that stores the toner received from the toner container and supplies the toner to the developing device;

a first seal member provided between the toner container and the container holder, when the toner container is engaged with the container holder;

a second seal member provided between the container holder and the hopper frame; and the container holder having an opening portion spaced from the first and second seal members, the opening portion providing a path so that an air pressure generated in the container holder when the toner container is being engaged with the container holder, is released via a space between the container holder and the hopper frame.

10. The copy machine according to claim 9, wherein the first seal member and the second seal member face each other and hold the container holder therebetween.

11. The copy machine according to claim 9, wherein the first seal member and the second seal member are positioned at a periphery of the first opening and the second opening when the toner container engages with the container holder.

12. The copy machine according to claim 9, further comprising a collar portion provided on the toner container, wherein the first seal member is held between the collar portion and the container holder when the toner container engages with the container holder.

13. The copy machine according to claim 9, wherein said first seal member and said second seal member are secured to said container holder, at opposing surfaces of a wall of said container holder.

14. The copy machine according to claim 9, wherein said opening portion comprises a plurality of circumferentially spaced opening portions.

15. The copy machine according to claim 9, said first seal member being configured to abut against a collar of the toner container that extends in a direction transverse to a longitudinal direction of said toner container.

16. The copy machine according to claim 9, said opening portion being provided in a wall surface of said container holder against which at least one of said first seal member and said second seal member one of abut and are secured to.

* * * * *

UNITED STATES PATENT AND TRADEMARK OFFICE

CERTIFICATE OF CORRECTION

PATENT NO. : 6,615,007 B2
DATED : September 2, 2003
INVENTOR(S) : M. Nakamura et al.

It is certified that error appears in the above-identified patent and that said Letters Patent is hereby corrected as shown below:

Column 8,
Line 38, "surface a wall" should be -- surfaces of a wall --.

Signed and Sealed this

Fifteenth Day of June, 2004

JON W. DUDAS
*Acting Director of the United States Patent and Trademark Office*